US010513784B2

(12) United States Patent
Schoenberg

(10) Patent No.: US 10,513,784 B2
(45) Date of Patent: Dec. 24, 2019

(54) TREATMENT DEVICE AND TREATMENT METHOD FOR PICKLING AND PHOSPHATING METAL PARTS

(71) Applicant: RIO VERWALTUNGS AG, Heiden AR (CH)

(72) Inventor: Joachim Schoenberg, Ummendorf (DE)

(73) Assignee: RIO VERWALTUNGS AG, Heiden AR (CH)

( * ) Notice: Subject to any disclaimer, the term of this patent is extended or adjusted under 35 U.S.C. 154(b) by 110 days.

(21) Appl. No.: 15/307,957

(22) PCT Filed: Feb. 4, 2015

(86) PCT No.: PCT/EP2015/052326

§ 371 (c)(1),
(2) Date: Oct. 31, 2016

(87) PCT Pub. No.: WO2015/165600

PCT Pub. Date: Nov. 5, 2015

(65) Prior Publication Data

US 2017/0051414 A1 Feb. 23, 2017

(30) Foreign Application Priority Data

Apr. 30, 2014 (DE) ..... 10 2014 006 315

(51) Int. Cl.
*C23F 11/04* (2006.01)
*C23C 22/73* (2006.01)
(Continued)

(52) U.S. Cl.
CPC ..... *C23F 11/04* (2013.01); *C23C 22/00* (2013.01); *C23C 22/08* (2013.01); *C23C 22/73* (2013.01);
(Continued)

(58) Field of Classification Search
CPC ..... C23C 22/00; C23C 22/08; C23C 22/73; C23G 1/00; C23G 1/02; C23G 1/06; C23G 3/00; C23F 4/00; C23F 11/04
See application file for complete search history.

(56) References Cited

U.S. PATENT DOCUMENTS 1,949,921 A 3/1934 Schweitzer
2,307,928 A * 1/1943 Hogaboom ..... C25F 1/00 204/206
(Continued)

FOREIGN PATENT DOCUMENTS

DE 31 34 231 A1 3/1983
DE 94 08 690.7 U1 7/1994
(Continued)

OTHER PUBLICATIONS

Written Opinion and International Search Report for PCT/EP2015/052326, English Translation of Written Opinion and International Search Report attached to Original Document, dated May 6, 2015, All together 25 Pages.
(Continued)

*Primary Examiner* — Benjamin L Osterhout
(74) *Attorney, Agent, or Firm* — Brooks Kushman P.C.

(57) ABSTRACT

A treatment device for single-stage treatment of a metal object to be treated by at least the steps of pickling and phosphating. The treatment device comprises at least the following: a treatment container for receiving the object to be treated and for receiving a flowable treatment substance; and a pump device for exchanging at least a fraction of the treatment substance. The treatment substance is flowable around at least one part of the object to be treated. The treatment substance comprises a phosphor- or phosphate-containing solution, in particular phosphoric acid. The phosphor- or phosphate-containing solution consists partly of water and partly of a reaction substance, and the reaction
(Continued)

substance consists of phosphor or a phosphate and an additional treatment effect-improving substance. The proportion of the phosphor or phosphate in the reaction substance is at least 95%, and the reaction substance does not have a salt acid or sulfuric acid content.

20 Claims, 10 Drawing Sheets

(51) Int. Cl.

| | |
|---|---|
| ***C23F 4/00*** | (2006.01) |
| ***C23C 22/08*** | (2006.01) |
| ***C23C 22/00*** | (2006.01) |
| ***C23G 1/00*** | (2006.01) |
| ***C23G 1/02*** | (2006.01) |
| ***C23G 3/00*** | (2006.01) |
| ***C23G 1/06*** | (2006.01) |

(52) U.S. Cl.
CPC ..... *C23F 4/00* (2013.01); *C23G 1/00* (2013.01); *C23G 1/02* (2013.01); *C23G 1/06* (2013.01); *C23G 3/00* (2013.01)

(56) References Cited

U.S. PATENT DOCUMENTS

| | | | | |
|---|---|---|---|---|
| 2,322,134 | A * | 6/1943 | Hodge | C01G 49/14 23/305 A |
| 2,769,735 | A * | 11/1956 | Miller | C23G 1/36 134/13 |
| 2,890,944 | A * | 6/1959 | Hays | C23F 1/28 148/253 |
| 3,144,361 | A * | 8/1964 | Klinghoffer | C23C 22/00 118/405 |
| 3,404,079 | A * | 10/1968 | Boardman | B05C 3/10 204/479 |
| 3,562,016 | A * | 2/1971 | Lancy | C23F 1/00 134/13 |
| 3,575,711 | A * | 4/1971 | Krofchak | C01G 49/14 134/13 |
| 3,961,991 | A | 6/1976 | Yoshida et al. | |
| 4,197,139 | A * | 4/1980 | Hjersted | C23G 1/36 134/12 |
| 4,298,405 | A | 11/1981 | Saus et al. | |
| 4,361,605 | A | 11/1982 | Takahashi et al. | |
| 4,381,249 | A | 4/1983 | Bouffard | |
| 5,024,707 | A | 6/1991 | Rausch | |
| 5,308,413 | A * | 5/1994 | Sobata | C23C 22/73 148/255 |
| 5,336,336 | A * | 8/1994 | Matsuda | C23C 22/00 148/240 |
| 5,510,018 | A * | 4/1996 | Rey | C23C 2/00 118/419 |
| 5,931,174 | A * | 8/1999 | Salas | B01D 17/0202 134/85 |
| 6,171,409 | B1 * | 1/2001 | Hamacher | C23C 22/73 118/410 |
| 6,235,111 | B1 * | 5/2001 | Comiso | C23C 22/00 118/226 |
| 2002/0001967 | A1 * | 1/2002 | Yokomizo | H01L 21/31111 438/745 |
| 2003/0136763 | A1 * | 7/2003 | Nakagawa | C09G 1/02 216/83 |
| 2004/0118483 | A1 | 6/2004 | Deemer et al. | |
| 2008/0257202 | A1 | 10/2008 | Miyata et al. | |
| 2011/0039122 | A1 | 2/2011 | Holzapfel et al. | |

FOREIGN PATENT DOCUMENTS

| | | | |
|---|---|---|---|
| DE | 198 58 035 | A1 | 1/2000 |
| DE | 101 55 976 | A1 | 5/2003 |
| DE | 101 60 858 | A1 | 7/2003 |
| EP | 0974682 | A1 | 1/2000 |
| FR | 1442457 | A | 6/1966 |
| GB | 647782 | A | 12/1950 |
| GB | 2280123 | A | 1/1995 |
| JP | 39-7122 | | 5/1964 |
| JP | 46-27933 | | 8/1971 |
| JP | 49-28092 | | 7/1974 |
| JP | 49-75430 | A | 7/1974 |
| JP | 51-33129 | A | 3/1976 |
| JP | 52-138028 | A | 11/1977 |
| JP | 56-62967 | A | 5/1981 |
| JP | 56-158896 | A | 12/1981 |
| JP | 57-47880 | A | 3/1982 |
| JP | 59-197574 | A | 11/1984 |
| JP | 61-69976 | A | 4/1986 |
| JP | 62-256971 | A | 11/1987 |
| JP | 3-75379 | A | 3/1991 |
| JP | 5-247664 | A | 9/1993 |
| JP | 5-89452 | U | 12/1993 |
| JP | 7-18463 | A | 1/1995 |
| JP | 9-111465 | A | 4/1997 |
| JP | 10-46376 | A | 2/1998 |
| JP | 2002-500702 | A | 1/2002 |
| JP | 2002-155375 | A | 5/2002 |
| JP | 2004-503678 | A | 2/2004 |
| JP | 2005-89804 | A | 4/2005 |
| JP | 2007-182591 | A | 7/2007 |
| JP | 2011-515573 | A | 5/2011 |
| JP | 2013-537584 | A | 10/2013 |
| RU | 2 358 035 | C2 | 6/2009 |

OTHER PUBLICATIONS

German Office Action dated Dec. 10, 2015, Application No. 10 2015 005 521.6, 6 Pages.

German Minutes of the Oral Proceedings, dated Sep. 1, 2016, Application No. 10 2015 005 521.6, 3 Pages.

Mexican First Office Action dated Dec. 14, 2016, Application No. MX/a/2016/014200, 2 Pages.

Japanese Notice of Grounds for Rejection dated Nov. 22, 2018, Application No. 2016-565183, 7 Pages.

Japanese Search Report dated Nov. 5, 2018 Application No. 2016-565183, 14 Pages.

* cited by examiner

TREATMENT DEVICE AND TREATMENT METHOD FOR PICKLING AND PHOSPHATING METAL PARTS

CROSS-REFERENCE TO RELATED APPLICATION

This application is the U.S. national phase of PCT Application No. PCT/EP2015/052326 filed on Feb. 4, 2015, which claims priority to German Patent Application No. DE 102014006315.1 filed on Apr. 30, 2014, the disclosures of which are incorporated in their entirety by reference herein.

TECHNICAL FIELD

The present invention relates to a treatment device for the single-stage treatment of objects, and to a treatment method for at least pickling and phosphating a metal object to be treated.

BACKGROUND

Previous treatment systems for phosphating objects require a plurality of working steps, in particular 7 working steps, and exhibit a plurality of different baths for this purpose. The object is here first placed in a first bath, in which a first liquid is provided for degreasing the object. After degreased, the object must be conveyed from the first bath and into a second bath. In the second bath, a rinsing liquid is provided for rinsing the object. After rinsing, the object is conveyed into a third bath. The third bath is filled with a salt acid/sulfuric acid mixture. After the salt acid/sulfuric acid treatment, the object is sequentially conveyed to two additional baths each filled with rinsing liquid in order to rinse the object. In addition, the object is conveyed into a bath for passivation after the last rinsing bath. After passivated, the object is phosphated and then conveyed to another location for drying. In such a system, the highly toxic and environmentally detrimental chemicals in the degreasing baths and in the treatment baths have to be completely replaced after approx. 6 to 8 weeks of production time, since the chemicals have been spent after this period, and accruing sludge must be removed from the baths. This results in a system shutdown and high replacement and disposal costs.

As evident, the systems known from prior art require a great deal of space on the one hand, since they have to provide six different baths, and very many different chemical substances in high quantities on the other. In addition, conveying the objects from one bath to the next takes a great deal of time, corresponding transport systems and operating personnel. Furthermore, the used chemicals are toxic and environmentally detrimental, e.g., since sulfuric acids and salt acids are used, which either requires that expensive safety measures be implemented, or poses a high risk to the personnel and environment, as well as to the usually steel support structure.

Another objective is to prevent hydrogen embrittlement of the treated workpieces or objects to be treated. Hydrogen embrittlement normally results from hydrogen penetrating into and becoming embedded in a metal grid, and may lead to material fatigue. Hydrogen embrittlement is encountered when atomic hydrogen arises on the metal surface, either through hydrogen corrosion or in some other chemical reaction during metal treatment in which hydrogen participates, and is bound to the material more rapidly than it combines into non-diffusible $H_2$ molecules on the material surface. A portion of the hydrogen is here embedded in the metal grid or deposited on defects or the grain boundary. Depending on the stress placed on the respective object, e.g., by introducing tensile residual stresses or loads, there exists a risk of material failure.

SUMMARY

Therefore, the object of the present invention is to provide a treatment device and treatment method, wherein the treatment device according to the invention and the treatment method according to the invention are to eliminate at least one disadvantage, and preferably several and especially preferably all aforementioned disadvantages of the treatment systems known from prior art for phosphating objects.

In a first aspect of the invention, the above object is achieved by a treatment device for the single-stage treatment of a metal object to be treated, wherein the treatment encompasses at least pickling and phosphating the object to be treated. The treatment device according to the invention, in particular a bath system, preferably encompasses a treatment container for receiving the object to be treated and for receiving a flowable treatment substance, and a pump device for changing at least a fraction of the treatment substance, wherein the treatment substance flows around at least one part of the object to be treated, in particular the entire object to be treated, wherein the treatment substance is a phosphor or phosphate-containing solution, in particular phosphoric acid, wherein the phosphor or phosphate-containing solution consists partly of water and partly of a reaction substance, wherein the reaction substance consists of phosphor or a phosphate and an additional treatment effect-improving substance, wherein the proportion of phosphor or phosphate in the reaction substance measures at least 95% (percent by volume), wherein the reaction substance does not have a salt acid and sulfuric acid content.

This solution is advantageous, since no toxic or environmentally detrimental chemicals are used. In addition, the treatment substance does not have to be changed and disposed every 6-8 weeks, since the treatment device according to the invention yields a system design in which the used chemicals are continuously purified. Losses in treatment substance caused by evaporation and carryover can be replenished by adding water and reaction substance, making it possible to reduce the required number of times the treatment substance must be changed per year to less than 4 changes, in particular to 2 or less than 2 changes, to 1 or less than 1 change. The treatment substance is preferably only changed when the treatment substance contains a predetermined concentration of dissolved iron, wherein a change preferably only takes place at a concentration of dissolved iron that exceeds 2%.

It is further advantageous that the present invention enables a very easy treatment of objects to be treated. The objects to be treated must essentially only be dipped into the treatment substance, the treatment substance must exert its effect, and then dry after the object to be treated has been removed from the bath. In particular, the ultrapure phosphor or ultrapure phosphate forms a protective layer after drying on the objects to be treated, thereby protecting the latter against failure for a prolonged period of time, in particular for several weeks, wherein this takes place without the passivation and subsequent phosphating required according to prior art, and wherein in particular the resultant protective layer is far superior compared to phosphating according to prior art. This solution is further advantageous because the treatment substance is incombustible, no MAK (maximum workplace concentration) values are exceeded by using the treatment substance, and no corrosive vapor is generated, so that no suction is necessary.

Another advantage to the present invention is that the used treatment effect-improving substances significantly preserve the material and do not impair weldability.

Yet another advantage has to do with the variety of applications of the invention. For example, it can be used for pre- and post-treatment in hardening shops, or it can be used for removing the oxide layer on aluminum. Furthermore, it makes it possible to avoid efflorescence during the galvanic post-processing of castings. As a consequence, there is a significant savings in spatulas during cast skin removal. For example, hydraulic pipes and pipelines can further be pickled directly at construction sites in a single operation, without rinsing and neutralization being required.

Aside from pickling and phosphating the object to be treated, it is especially preferred that the treatment device according to the invention preferably also degrease and/or derust and/or descale and/or preserve and/or decalcify the object to be treated.

Strictly by way of example, the following can preferably be treated as the objects to be treated: Metal parts, such as aluminum parts, iron parts, cast iron parts, wire, steel parts, copper parts or parts comprised of alloys, polymer parts, such as plastic parts or rubber parts, etc., in particular vehicle frames, pipes, machine parts, turbocharger parts, housings, auto parts, hydraulic parts, cast steel parts, and turbine parts.

Unless otherwise derived from the subject matter of this invention, the percentages indicated in the invention are in percent by volume. In addition, let it be mentioned that the indicated percentages and indicated temperatures in ° C. in the invention relate to the ambient pressure or normal pressure, unless otherwise derived from the subject matter of the invention, in addition to which the indications in ° C. can also apply accordingly for Kelvin. However, data in the invention relating to physical units need not be further explained to the expert in terms of the overall disclosure of the invention; but should a physical parameter be modified, it is evident to the expert that the resultant changes in other physical variables become adjusted accordingly, without departing from the protective scope of the invention in the process.

Advantageous embodiments of the invention may be gleaned from the subclaims, wherein a temperature control device is provided for controlling the temperature of the treatment substance that can be held in the treatment container, wherein the temperature control device can be used to definably set the temperature of the treatment substance.

The preferred temperature of the treatment substance is preferably higher than 0° C., in particular higher than or equal to 5° C., higher than or equal to 10° C., higher than or equal to 15° C., higher than or equal to 17° C., higher than or equal to 20° C., higher than or equal to 25° C., higher than or equal to 30° C., higher than or equal to 35° C., higher than or equal to 37° C., higher than or equal to 40° C., preferably between 20° C. and 60° C., and especially preferably between 30° C. and 50° C. While controlling the temperature of the treatment substance preferably takes the form of heating the treatment substance, it is also conceivable that controlling the temperature involves a cooling. It is further conceivable that the temperature control device can be used to sometimes heat and sometimes cool the treatment substance. The temperature control device is preferably designed as an electric heater, electric cooler and/or heat exchanger system. The operating sequence can be controlled as a function of the temperature of the treatment substance. Strictly by way of example, the acceleration factor can measure 20:20 C×6 while degreasing rust. This means that the object being treated can be made rustproof while being treated at 20° C. for 2 hours, or while being treated at 40° C. for 20 minutes.

An especially preferred operating temperature range lies at 35° C. to 45° C., wherein this temperature range is advantageous because no suction is required, since no corrosive or harmful vapors arise. However, it is conceivable to provide suctioning, for example if the workspace is extremely low or the workspace cannot be ventilated.

The phosphor and phosphate-containing solution preferably consists of fully decalcified water and the reaction substance, wherein the fraction of reaction substance relative to the fraction of fully decalcified water lies between 1:4 and 1:7, wherein the fraction of reaction substance relative to the fraction of fully decalcified water preferably measures 1:6 if the reaction substance is present in a solid state, or wherein the fraction of reaction substance relative to the fraction of fully decalcified water preferably measures 1:5 if the reaction substance is present in a liquid state.

In another advantageous embodiment of the invention, the reaction substance further exhibits no fractions of fluorine, chlorine, bromine, iodine, lead, mercury and selenium, so that the device according to the invention operates without any harmful or environmentally detrimental materials or substances.

The pump device is preferably designed as a circulating pump, and preferably circulates the treatment substance inside of the treatment container. However, it is alternatively or additionally also conceivable that a pump device be provided for generating a dam flow. The pump device is preferably coupled with one or more nozzles, through which the treatment substance is dispensed in particular into treatment containers, in particular for bath circulation.

The treatment container can preferably be fabricated in any size desired. It is especially preferred that the interior of the treatment container, i.e., the side that is in contact with the treatment substance, exhibit a material or material mixture that is not attacked by the treatment substance. Among others, preferred materials here include: stainless steel, GVP, PVC, for example. However, it is also conceivable for not only the surface of the treatment container in contact with the treatment substance to consist of such a material, but also for additional elements of the treatment container, in particular the entire treatment container, to consist of such a material or material mixture.

A preferred embodiment of the present invention provides a filter device for filtering the treatment substance, wherein filtration removes contaminants from the treatment substance that accumulate in the treatment substance. This embodiment is advantageous, since the treatment substance in the treatment container can be continuously or intermittently purified or conditioned.

In another preferred embodiment of the present invention, the treatment container is coupled with at least two receiving chambers, wherein a first receiving chamber is a buffer receiving chamber preferably formed underneath the treatment chamber for receiving a specific quantity of the treatment substance, and wherein a second receiving chamber is a temperature control chamber preferably formed to the side of the treatment chamber, wherein the temperature control device is at least partially situated in the temperature control chamber. For example, the first receiving chamber or buffer chamber can be used to hold a desired volume of treatment substance. It is further conceivable that the first receiving chamber or buffer chamber be used to receive or deposit sediments. For example, the sediments can here be parts or particles that detach from the objects being treated during the treatment. The temperature control chamber is preferably situated to the side next to the treatment container, since this can provide a very good access to the temperature control device. However, it is further alternatively also conceivable that the temperature control device be formed or arranged in the first receiving chamber or in the buffer chamber, i.e., underneath the treatment container. This embodiment is advantageous, since the individual fractions of treatment substance can get into various functional areas or receiving chambers and the primary receiving chamber without the possibility of damage being done to systems formed or arranged in one or more receiving chambers, such as the temperature control device, as the result of collision with the object to be treated.

In yet another preferred embodiment of the present invention, the treatment container is separated by a wall from a collecting chamber for collecting treatment substance flowing over the wall, wherein the treatment substance collected in the collecting chamber can be conveyed back into the treatment container via a conveying line by means of a conveying device, in particular the pump device. This embodiment is advantageous, since the particles that accumulate on the surface of the treatment substance and detach from the object to be treated and/or foam that forms on the surface of the treatment substance and/or whatever other material concentrations can be discharged from the treatment container, and preferably fed to the filter device.

In another preferred embodiment of the present invention, the pump device and filter device make up part of the conveying line, and the conveyed treatment substance is preferably conveyed from or by the pump device through the filter device. This embodiment is advantageous, since this arrangement causes the pump device to convey the treatment substance through the filter device, and at least partially circulate the treatment substance in the treatment container.

In another preferred embodiment of the present invention, the or a conveying line is configured in such a way that the treatment substance conveyed back into the treatment container can preferably generate a dam flow for discharging a portion of the treatment substance from the treatment container and into the collecting chamber. This embodiment is advantageous, since preferably one pump device can be used to convey the treatment substance through the filter device, at least partially circulate the treatment substance in the treatment container, and generates a dam flow.

Another preferred embodiment of the present invention provides a metering device for adjusting the composition of the treatment substance, wherein the treatment substance consists of a mixture of several components. The metering device is preferably coupled with one or more sensor means either directly or indirectly via a control device, wherein the sensor means preferably make it possible to monitor or analyze the composition of the treatment substance and/or monitor the volume or remaining quantity or fill level of the treatment substance present in the treatment container.

In particular, the metering device compensates for losses caused by adding the corresponding quantity of lost treatment substance, with in particular evaporation and/or dipping losses being compensated. The metering device preferably handles the addition of components that yield the treatment substance, in particular fully decalcified water, reaction substance and treatment effect-improving substance. The components yielding the treatment substance are preferably added in a fixed ratio, in particular the ratio in which the individual components are also provided in the treatment container, or in some other fixed ratio. It is further conceivable that the treatment substance to be added be in the form of a finished mixture or finished solution when added.

The sensor means can preferably be designed as a device for performing a titration process, i.e., for determining the concentration. However, it is likewise conceivable for the substances to partially, occasionally or always be manually metered and introduced into the treatment substances.

In another preferred embodiment of the present invention, the fraction of reaction substance relative to the fraction of fully decalcified water lies between 1:4 and 1:7, wherein the fraction of reaction substance relative to the fraction of fully decalcified water preferably measures 1:6 if the reaction substance is mixed with the fully decalcified water in a solid state, or wherein the fraction of reaction substance relative to the fraction of fully decalcified water preferably measures 1:5 if the reaction substance is mixed with the fully decalcified water in a liquid state.

The losses are preferably also replaced in a fixed ratio between several substances. As a consequence, the preferred substance(s) is/are here flowable, in particular liquid, or solid reaction substance(s), which preferably is/are mixed with a diluent substance, e.g., water, in particular desalinated or distilled water or fully decalcified water (VE water). Preferred mixing ratios between the reaction substance and diluent substance, in particular fully decalcified water, here further exemplarily measure 1:2; 1:3, 1:4, 1:5; 1:6; 1:6.5; 1:7.5; 1:8; 1:8.5; 1:9.

Depending on the values generated by the sensors, a mixture or solution of one or more additional substances, in particular one or more liquids, in particular fully decalcified water, and/or one or more preferably soluble additive, are preferably automatically or manually mixed in with the treatment substance. It is further conceivable that an additional substance, in particular for pickling and degreasing and/or defoaming, be added to the treatment substance. The additional substance is preferably added to the treatment substance at approx. 0.5% to 10%, in particular 1% to 5%, of the volume of the treatment substance. The use of fully decalcified water is here preferred, since this essentially results in a constant surface quality on the objects to be treated.

The use of a pickling degreaser is advantageous, since adding the latter to the treatment substance makes it possible to remove contaminants, such as minor fat deposits, dirt particles, oil, carbon and graphite in the same operation.

In a particularly preferred embodiment of the present invention, the treatment substance is a phosphor or phosphate-containing solution, in particular phosphoric acid, wherein the phosphor fraction or phosphate fraction of the solution is preferably ultrapure, i.e., exhibits a purity exceeding 95%, in particular exceeding 96%, 97%, 98%, 99% and preferably exceeding 99.5%. Given the purity of the phosphor fraction or phosphate fraction of the treatment substance according to the invention, the latter exhibits nearly no contaminants, so that a corresponding protective layer is formed on the object to be treated.

The pH value of the reaction substance preferably lies essentially at 1, the density of the reaction substance at a temperature of 20° C. preferably lies at 1.8, and the flashpoint of the reaction substance preferably lies at 280° C. or preferably higher than 280° C.

In the case of objects to be treated that exhibit aluminum or consist of aluminum, the treatment substance preferably exhibits fully decalcified water, and preferably in addition to the fully decalcified water a reaction substance in a quantity 1-10%, in particular 3-5%, of the quantity of fully decalcified water. At a bath temperature of 40° C. to 45° C., i.e., when the treatment substance has been brought to a temperature of 40° C. to 45° C., the exposure time, i.e., the time for which the object to be treated in the treatment container is exposed to the treatment substance, preferably measures 0.5 min. to 20 min., and especially preferably 1 min. to 10 min. The reaction substance here preferably consists of phosphoric acid and inhibitors.

In another preferred embodiment of the present invention, the treatment substance exhibits an additional substance for pickling and degreasing, or such an additional substance is incorporated into a treatment substance, wherein the pickling and degreasing additive preferably exhibits an aqueous solution of non-ionogenic, biodegradable surfactants and inhibitors, in particular But-2-in-1, 4-diol, and wherein the pickling and degreasing additive is added with a volume of 0.5% to 7% of the volume of the phosphor or phosphate-containing solution or the treatment substance.

In another preferred embodiment of the present invention, the treatment substance exhibits an additional substance for defoaming, wherein the defoaming additive preferably exhibits triisobutyl phosphate, and wherein the defoaming additive is added to the treatment substance with a volume of 0.01% to 5%, in particular with a volume of 0.1% to 1%, of the volume of the phosphor or phosphate-containing solution or the treatment substance, or with a volume of 0.01% to 5%, in particular with a volume of 0.1% to 1%, of the volume of the phosphor or phosphate-containing solution reacted with the pickling and degreasing additives or the treatment substance.

Another preferred embodiment of the present invention provides a control device, wherein the control device controls the temperature control device in such a way that the treatment substance is brought to a target temperature or target temperature progression and/or wherein the control device controls the pump device in such a way that the treatment substance is conveyed at a target flow rate or target flow characteristic, and/or the control device controls the filter device in such a way that the filtered fraction of treatment substance exhibits a target purity, and/or the control device controls the metering device in such a way that a target composition of the treatment substance can be set.

In another embodiment or several additional embodiments, it is further conceivable for the treatment device to exhibit one or more oil separation system(s), ultrasound system(s), high-pressure system(s), rotating and hoisting device(s) and/or fully decalcified water supply system(s).

Another preferred embodiment of the present invention can provide a degreasing bath, in particular for degreasing the objects to be treated with an unusually high fat content, in particular placed upstream from the treatment container. This embodiment is advantageous, since the treatment substance in the degreasing bath can preferably be heated to a temperature that exceeds the preferred operating temperature or treatment temperature of the treatment substance in the treatment container. The temperature in the degreasing bath is preferably greater than 50° C., in particular greater than 52° C., and especially preferably greater than or equal to 60° C. This embodiment is advantageous, since only very heavily oiled or greased objects to be treated can be introduced into a degreasing bath suitably temperature controlled for degreasing. This has significant energy advantages, since the degreasing bath heated preferably to more than 50° C. preferably does not have to be temperature controlled permanently, but only intermittently. Furthermore, the formation of water vapor in the area of the treatment container of the treatment device according to the invention can be prevented if the temperature of the treatment substance is under a threshold temperature, in particular under 52° C., or if heating does not take place in excess of this threshold temperature.

The invention further relates to a treatment method for at least pickling and phosphating an in particular metal object to be treated. The method according to the invention preferably encompasses the steps of providing a treatment container for receiving at least one object to be treated and for receiving a flowable treatment substance, wherein no additional treatment container is used for degreasing and phosphating, introducing the treatment substance into the treatment container and introducing the object to be treated into the treatment container at least partially filled with the treatment substance to bring the object to be treated into contact with the treatment substance, wherein the contact between the treatment substance and object to be treated triggers at least a pickling and phosphating of the object to be treated, wherein the treatment substance is a phosphor or phosphate-containing solution, in particular phosphoric acid, wherein the phosphor or phosphate-containing solution consists of fully decalcified water on the one hand and a reaction substance on the other, wherein the reaction substance consists of phosphor or a phosphate and an additional treatment effect-improving substance, wherein the fraction of phosphor or phosphate in the reaction substance measures at least 95%, wherein the reaction substance in particular exhibits no fractions of salt acid and sulfuric acid.

The treatment method is advantageous, since a closed circuit is created that requires no rinsing process, and hence no conveying of the object into a sink. In addition, the method according to the invention is highly advantageous, since especially by comparison to mechanical treatment methods, it enables a very thorough, gentle and rapid treatment of the object to be treated. This solution is further advantageous because the treatment substance is incombustible, no MAK (maximum workplace concentration) values are exceeded by using the treatment substance, and no corrosive vapors are generated, so that no suction is necessary.

The objects to be treated preferably remain in the treatment container together with the treatment substance for more than 5 minutes, in particular for more than 10 minutes, and preferably for between 20 minutes and 120 minutes, in particular for between 30 minutes and 90 minutes.

Aside from pickling and phosphating, the method according to the invention also results in the degreasing and/or derusting and/or descaling and/or preserving and/or decalcification of the object to be treated, especially preferably by exposing the object to be treated to the treatment substance.

In another preferred embodiment of the present invention, a pore-free protective layer that prevents hydrogen embrittlement is generated on the surface of the object to be treated by means of the treatment substance, in particular by means of the reaction substance, wherein the protective layer exhibits a thickness of at least 2 μm, and preferably of at least 3 μm. In particular, the pore-free protective layer protects the object to be treated against oxygen and water, thereby effectively preventing a rust attack.

The protective layer, in particular a phosphate layer, in particular an iron phosphate layer, is preferably produced by the treatment method according to the invention, in particular after a drying period of 3 hours to 48 hours, in particular of 6 hours to 24 hours, in the ambient air, or after a drying period of approx. 5 min. to 60 min., in particular of approx. 20 min., in a furnace at 70° C. to 150° C., in particular at approx. or precisely 100° C., on the material surface of the object to be treated (in particular comprised of iron or standard steel). The formed protective layer is preferably between 2 μm and 10 μm, in particular more than or precisely 3 μm, 4 μm or 5 μm thick. It is especially preferred that the protective layer exhibit a thickness of 2 μm to 10 μm, and preferably of 3 μm to 8 μm, and especially preferably of 4 μm to 6 μm. The protective layer preferably exhibits no or essentially no pores, and is thus especially preferably without pores. Furthermore, the protective layer is elastic, and especially preferably adjusts to temperature fluctuations of −60° C. to 750° C., and especially preferably of −40° C. to 680° C., without flaking in the process, wherein the protective layer preferably exhibits a high bendability, in particular of up to 180° or in excess of 180° (e.g., for iron rods). The protective layer can here serve as an excellent foundation for continued treatment, in particular for a color treatment, for example which can come after the method according to the invention. The protective layer preferably reacts neutrally, and does not enter into any chemical bonds with hydraulic fluids. Additional extremely important advantages to the method according to the invention are that the protective layer prevents rust from attacking the objects to be treated, and that pickling is accompanied by a material removal of preferably less than 10 g/qm, in particular of less than 5 g/qm, and especially preferably of or less than 2.24 g/qm.

In addition, the treatment method according to the invention preferably also exhibits the step of controlling the temperature of the treatment substance that can be kept in the treatment container and/or the step of generating a flow of at least a portion of the treatment substance, wherein the treatment substance flows around at least one part of the object to be treated.

In another preferred embodiment of the present invention, the temperature of the treatment substance that can be kept in the treatment container is controlled by means of a temperature control device, wherein the temperature control device is used to definably set the temperature of the treatment substance, and wherein a pump device [generates] a flow for moving at least a fraction of the treatment substance, wherein the treatment substance flows around at least one part of the object to be treated.

In another preferred embodiment of the present invention, a filter device is used to filter the treatment substance, wherein filtration removes contaminants from the treatment substance that have accumulated in the treatment substance.

In another preferred embodiment of the present invention, the treatment container is separated by a wall from a collecting chamber for collecting treatment substance flowing over the wall, wherein the treatment substance collected in the collecting chamber is conveyed back into the treatment container via a conveying line by means of a conveying device, in particular the pump device.

In another preferred embodiment of the treatment method according to the invention, the pump device and filter device make up part of the conveying line, and the conveyed treatment substance is conveyed through the filter device by the pump device.

In another preferred embodiment of the treatment method according to the invention, the conveying line is configured in such a way that the treatment substance conveyed back into the treatment container generates a dam flow for discharging a portion of the treatment substance from the treatment container and into the receiving chamber.

In another preferred embodiment of the treatment method according to the invention, a metering device is used to control the composition of the treatment substance, wherein the treatment substance consists of a mixture of several components.

In another preferred embodiment of the present invention, the treatment substance incorporates an additional substance for pickling and degreasing and/or an additional substance for defoaming, wherein the pickling and degreasing additive preferably exhibits an aqueous solution of non-ionogenic biodegradable surfactants and inhibitors, in particular But-2-in-1, 4-diol, and wherein the pickling and degreasing additive is added with a volume of 0.5% to 7% of the volume of the phosphor or phosphate-containing solution or the treatment substance, and wherein the defoaming additive preferably exhibits triisobutyl phosphate, and wherein the defoaming additive is added to the treatment substance with a volume of 0.1% to 1% of the volume of the phosphor or phosphate-containing solution, or with a volume of 0.1% to 1% of the volume of the phosphor or phosphate-containing solution reacted with the pickling and degreasing additive or the treatment substance.

In another preferred embodiment of the present invention, a control device is used to control the temperature control device in such a way that the treatment substance is brought to a target temperature or target temperature progression and/or wherein the control device controls the pump device in such a way that the treatment substance is conveyed at a target flow rate or target flow characteristic, and/or the control device controls the filter device in such a way that the filtered fraction of treatment substance exhibits a target purity, and/or the control device controls the metering device in such a way that a target composition of the treatment substance can be set.

In all instances where said words are used in the framework of the present invention, the use of the word "essentially" preferably defines a deviation of 1%-30%, in particular of 1%-20%, in particular of 1%-10%, in particular of 1%-5%, in particular of 1%-2%, from the definition that would be given without the use of these words.

Individual or all illustrations in the figures described below are preferably to be regarded as design drawings, i.e., the dimensions, proportions, functional correlations and/or arrangements derived from the figure(s) preferably correspond precisely or essentially to those for the device according to the invention or product according to the invention.

Additional advantages, objectives and properties of the present invention will be explained based on the following description of attached drawings, which exemplarily illustrate treatment devices according to the invention. Elements of the devices and methods according to the invention that at least essentially match up in terms of function on the figures can here be labeled with the same reference numbers, wherein these components or elements need not be numbered or explained in all figures. The invention will be described in a purely exemplary manner below based on the attached figures.

DETAILED DESCRIPTION

Figure 1:
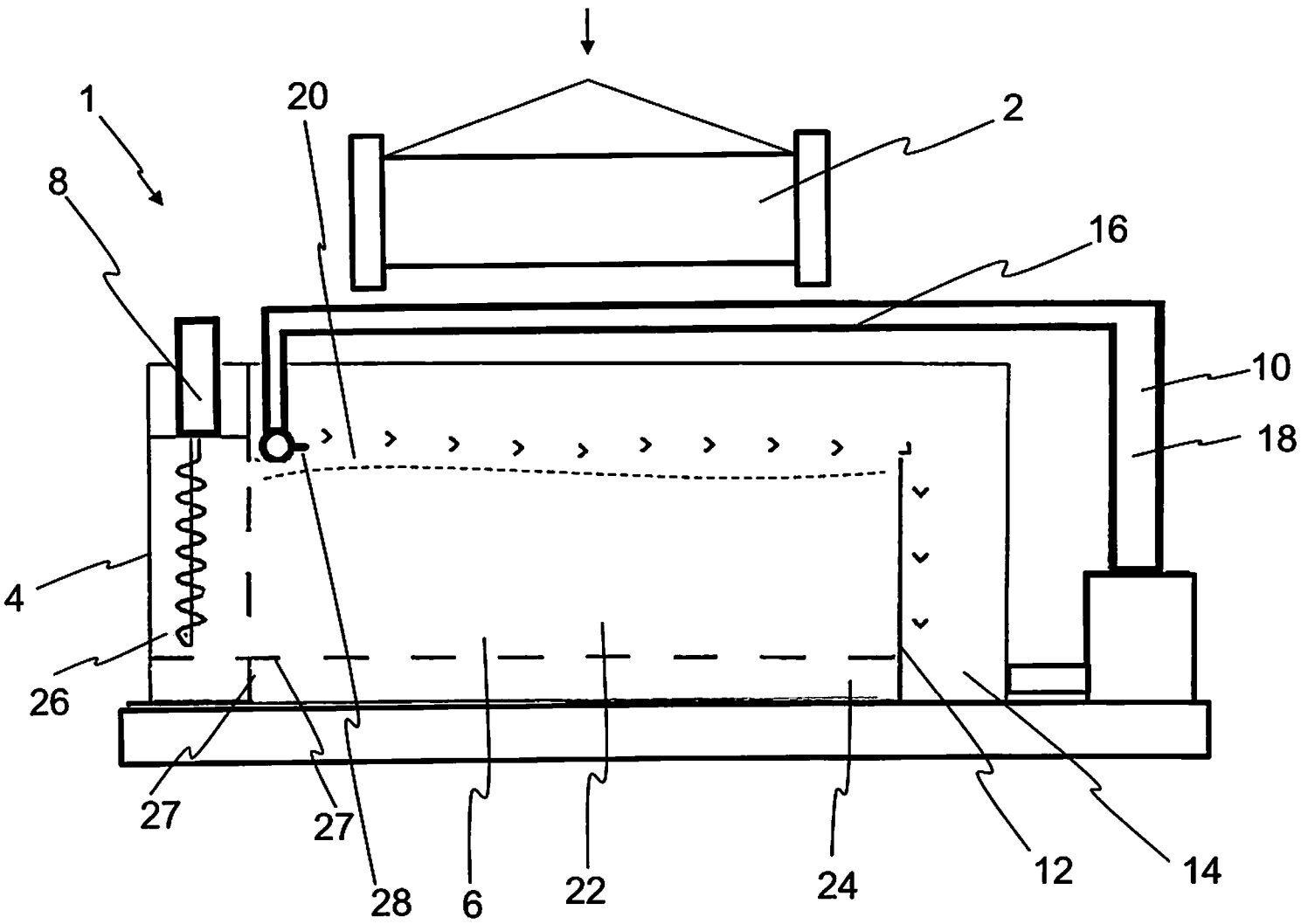
FIG. 1 is a first view of a treatment device according to the invention in a passive state.

FIG. 1 shows the treatment device 1 according to the invention. The treatment device 1 is used for treating, in particular degreasing, pickling, phosphating, descaling, preserving and derusting one or more objects to be treated 2. The object to be treated 2 is preferably introduced from above into a treatment container 4 of the treatment device 1. The treatment container 4 is here preferably at least partially and especially preferably completely filled with a treatment substance 6. In addition, a temperature control device 8 is preferably provided for controlling the temperature of the treatment substance 6, in particular heating it. Furthermore, at least one pump device 10 is preferably provided for circulating the treatment substance and/or generating a dam flow 20 and/or conveying treatment substance 6 discharged from the treatment container 4 back into the treatment container 4. The treatment container 6 is separated by a wall 12 from a collecting chamber. The flow generated in the treatment container 4 causes treatment fluid 6 to exit the treatment container 4 over the wall 12, so that it thereby gets into the collecting chamber 14. However, it is likewise possible that the treatment substance or fluid 6 be displaced in such a way by introducing the object to be treated 2 into the treatment chamber 4 that a portion of the treatment substance 6 exits the treatment container 4 over the wall 12. Reference number 16 denotes a conveying line that is used to convey the treatment substance 6 that exited the treatment container 4 back into the treatment container 4. A filter device 18 for filtering or preparing the treatment substance 6 is preferably situated in the area of the conveying line 16 or in the conveying line 16, or provided as part of the conveying line 16. It is here conceivable that the pump device 10 or another pump device (not shown) be located or formed in the progression of the conveying line 16. Furthermore, a pump/filter device can be provided, which either replaces a pump device and/or a filter device, or can be additionally provided. As may also be gleaned from the illustration, the treatment container 4 preferably exhibits at least one primary receiving chamber 22, a first ancillary receiving chamber 24 and a second ancillary receiving chamber 26. For example, the individual receiving chambers 22, 24, 26 are here separated from each other by grids 27, in particular by a respective single grate. The grid 27 here prevents the object to be treated 2 from being able to get into one of the ancillary receiving chambers 24, 26. Reference number 28 denotes a nozzle that can be used to generate a flow of the treatment substance 6.

Figure 2:
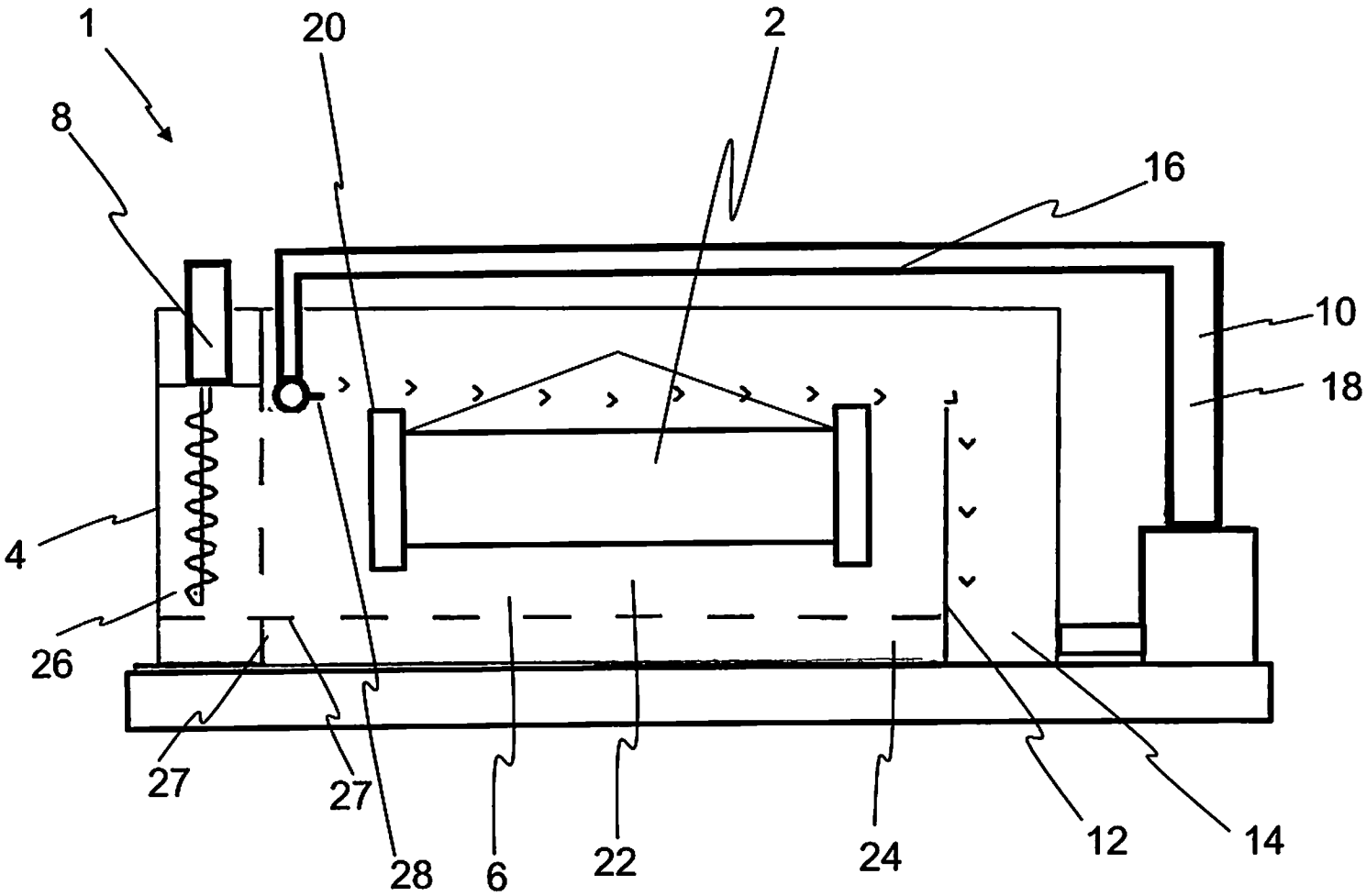
FIG. 2 is a second view of a treatment device according to the invention in an active state.

FIG. 2 shows the view known from FIG. 1, wherein the object to be treated 2 is situated in the treatment container 4 in this view, and thereby in contact with the treatment substance 6.

Figure 3:
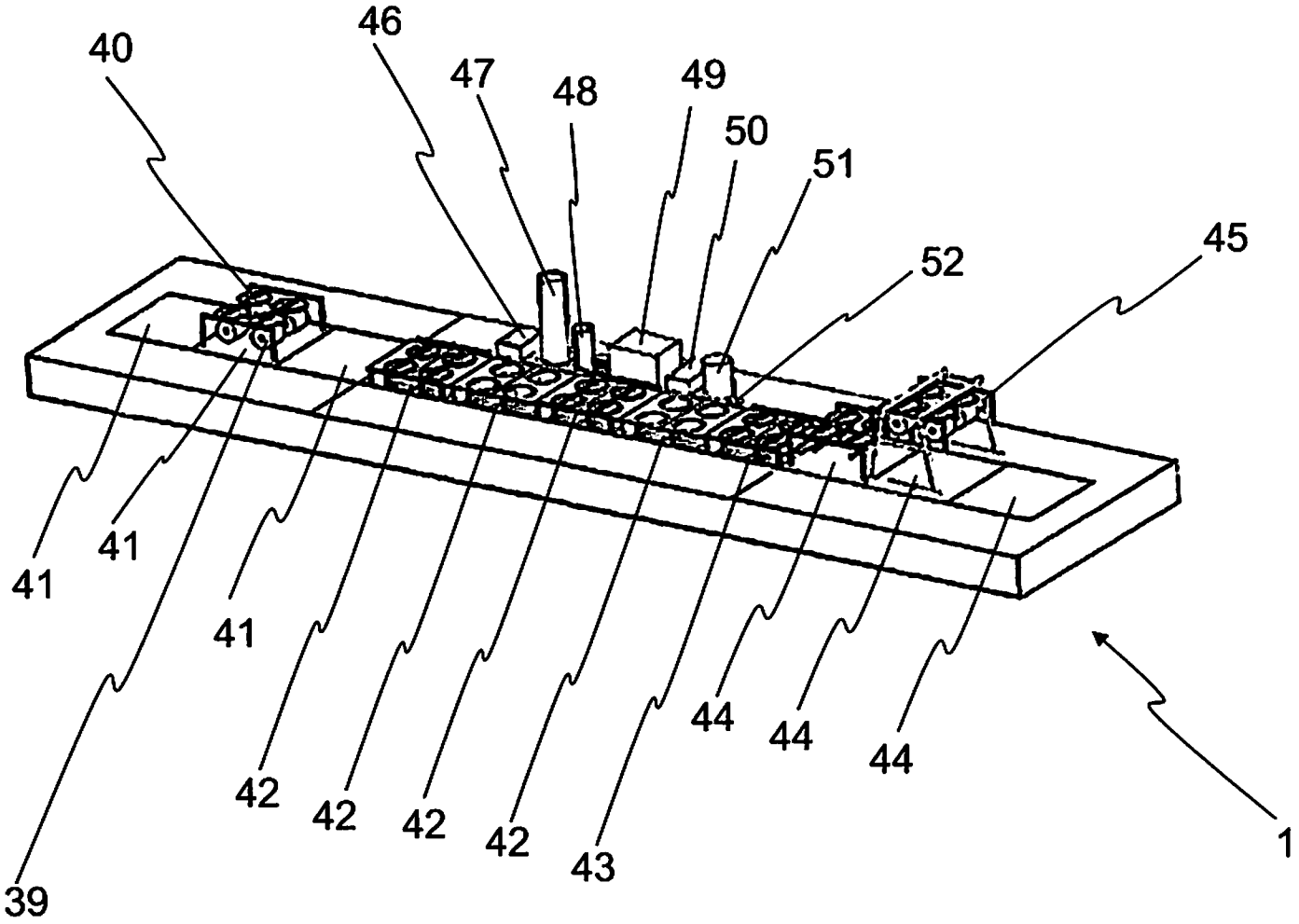
FIG. 3 is a perspective view of another treatment device according to the invention.

FIG. 3 shows another configurational variant of a treatment device 1 according to the invention, in particular for wire coil treatment. The treatment device 1 depicted on FIG. 3 exemplarily exhibits a receiving rack 40, which preferably carries several wire coils 39 to be treated. The receiving rack 40 is here situated on a delivery point 41, wherein preferably several receiving racks 40 and several delivery points 41 are provided. In addition, the treatment device 1 preferably exhibits several, in particular 2, 3, 4, 5, 6, 7, 8 or more treatment baths 42. A plurality, in particular 2, 3, 4, 5, 6, 7, 8, 9 or more wire coils 39 can preferably be introduced into a treatment bath 42 for treatment, in particular simultaneously. Reference number 43 denotes a preferably purely optional device, specifically a fixation bath. It is here conceivable that several, in particular 2, 3, 4, 5, 6, 7, 8 or more, wire coils 39 can be simultaneously introduced into a fixation bath 43. It is further conceivable that several fixation baths 43 be provided. The treated wire coils 39 can be arranged at a removal point 44 for removal purposes. The treated wire coils 39 are preferably conveyed with a transport device 45, in particular a transport carriage or rail-guided portal crane, to the respective removal point 44. Several devices are further preferably provided for supplying, regulating and controlling the treatment device 1. For example, the depicted embodiment exhibits a pressure belt filter device 46, a metering device 47, a fully decalcified water preparation device 48, a control device 49, another pressure belt filter device 38, a storage tank for treatment basins 51 and several side channel compressors 52, in particular 8 of them. The metering device 47 is preferably automated, and especially preferably exhibits a buffer tank with a volume that preferably exceeds 5 $m^3$, especially preferably exceeds 10 $m^3$, and most preferably exceeds or precisely equals 20 $m^3$.

Figure 4:
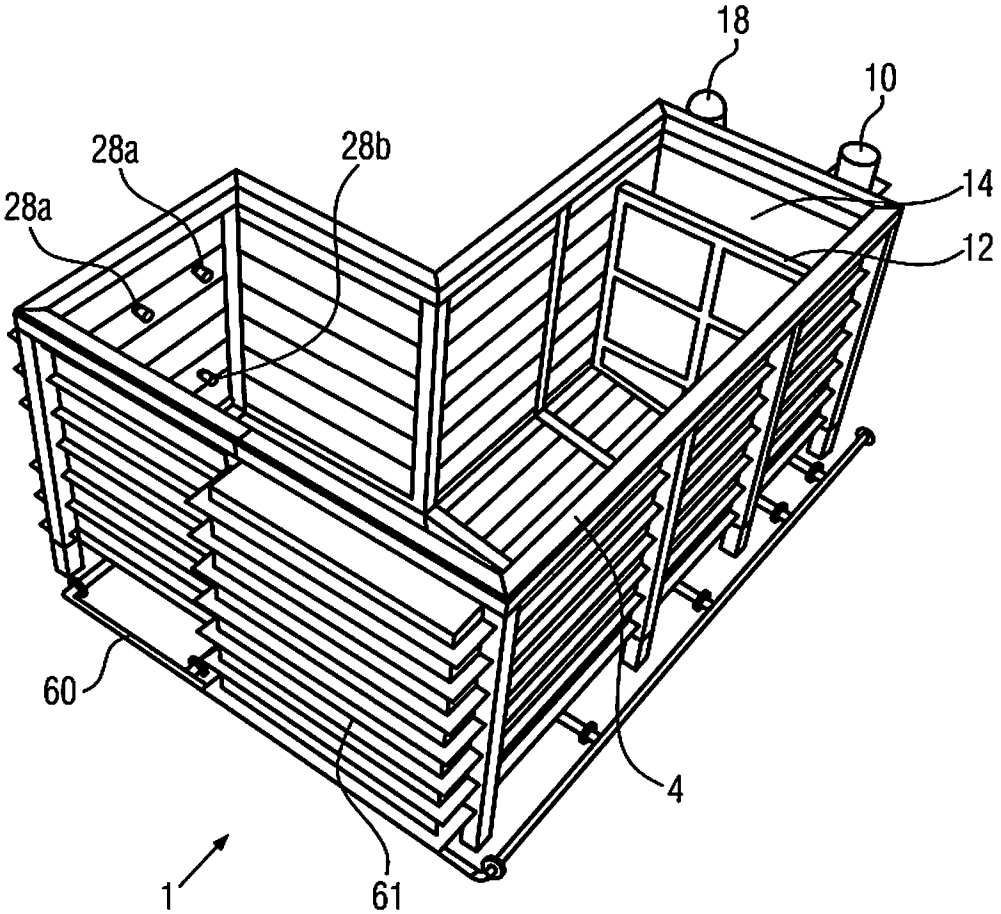
FIG. 4 is a perspective view of yet another treatment device according to the invention.

FIG. 4 shows a perspective view of a treatment device 1 according to the invention. The treatment device 1 is preferably L-shaped in design, i.e., it encompasses a treatment container 4, wherein the treatment container 4 exhibits a first interior portion that preferably extends at a right angle to a second interior portion. One interior portion is preferably longer than the other interior portion, wherein it is also conceivable that the interior portions are equally long or essentially equally long. For example, the structural design shown makes it possible to treat bent elements, such as pipes, carriers, claddings, etc. The treatment container 4 preferably exhibits at least or precisely one wall 12, wherein the wall 12 separates an area into which the objects to be treated are introduced from a collecting chamber 14. The collecting chamber 14 preferably serves to collect treatment substance that exits the treatment chamber over the wall 12.

Reference number 10 denotes a pump device, in particular for generating a flow inside of the treatment substance to be introduced into the treatment chamber. Reference number 18 denotes a filter device 18 for filtering or preparing the treatment substance.

The treatment substance is made to move or flow by means of nozzles 28*a*, 28*b* and 29*a*, 29*b*, 29*c* (see FIG. 5), from which the treatment substance conveyed via the pump device 10 is pumped into the treatment chamber.

The enclosure 61 envelops or houses the nozzles 29*a*-29*c*. Preferably provided are three rows of 2 nozzles 28*a*, 28*b* and three rows of three nozzles 29*a*, 29*b*, 29*c*, with it also being conceivable that precisely or at least one nozzle 28 and/or 29 be provided. The nozzles 28 are especially preferably inclined relative to the nozzles 29, in particular at a right angle.

Figure 7:
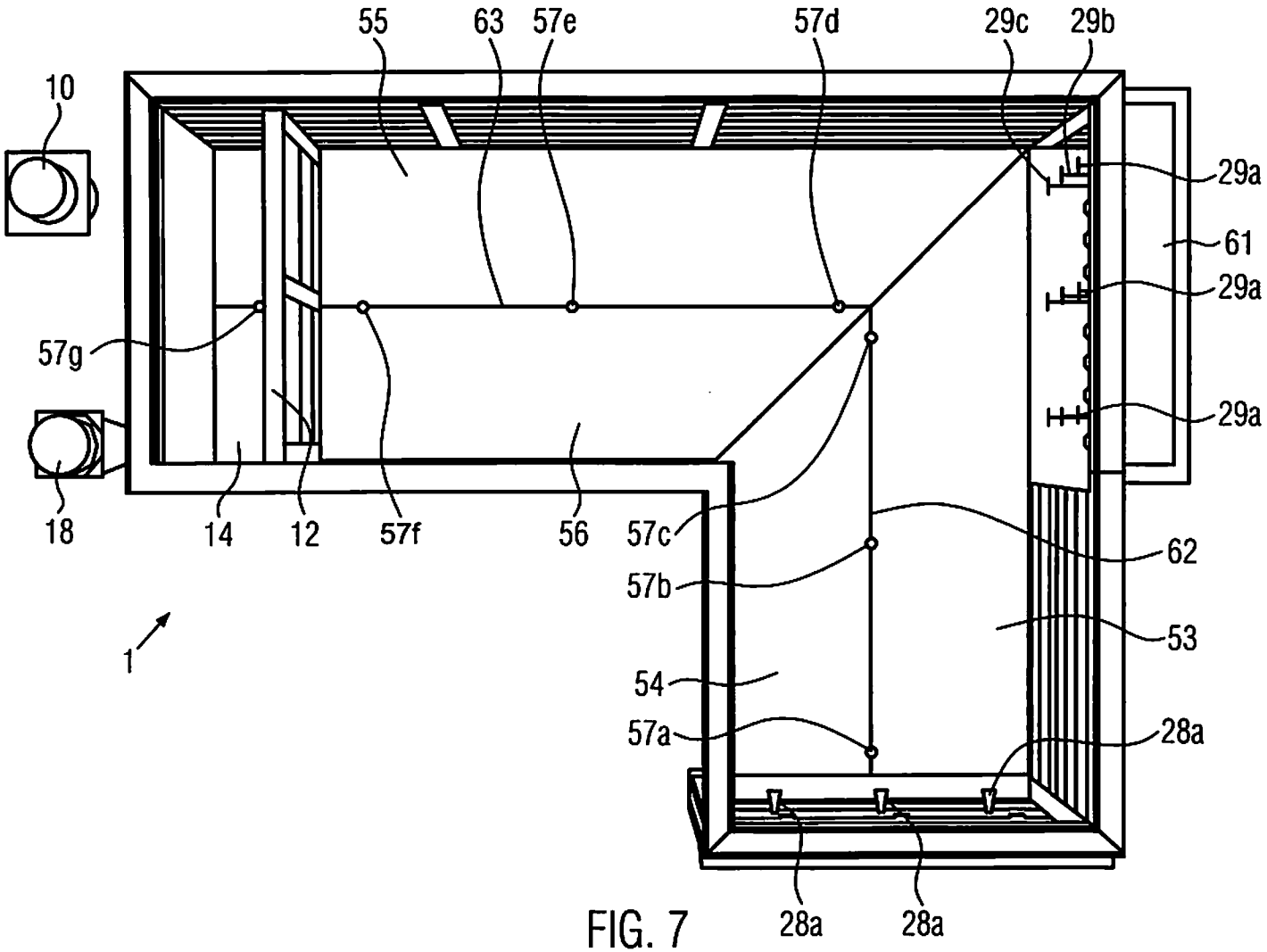
FIG. 7 is a first top view of the treatment device according to the invention shown on FIGS. 4 to 6.

Reference number 60 denotes a primary suction line, which is used to discharge, in particular siphon off, treatment substance from the treatment chamber via outlets 57*a*-57*g* (see FIG. 7). The discharged treatment substance is preferably prepared by means of the filter device 18, and conveyed back into the treatment chamber by means of the pump device 10 via the nozzles 28 and 29.

The treatment device 1 can preferably be dimensioned in such a way that an installation surface of 5100 mm×3800 mm is required. The treatment device 1 preferably encompasses a bath volume of essentially, up to, at least or precisely 14 $cm^3$. The effective volume of the treatment device 1 according to the invention preferably measures 3400 mm×3000 mm×1500 mm, and the height of the overflow to the top edge preferably measures 200 mm.

Figure 5:
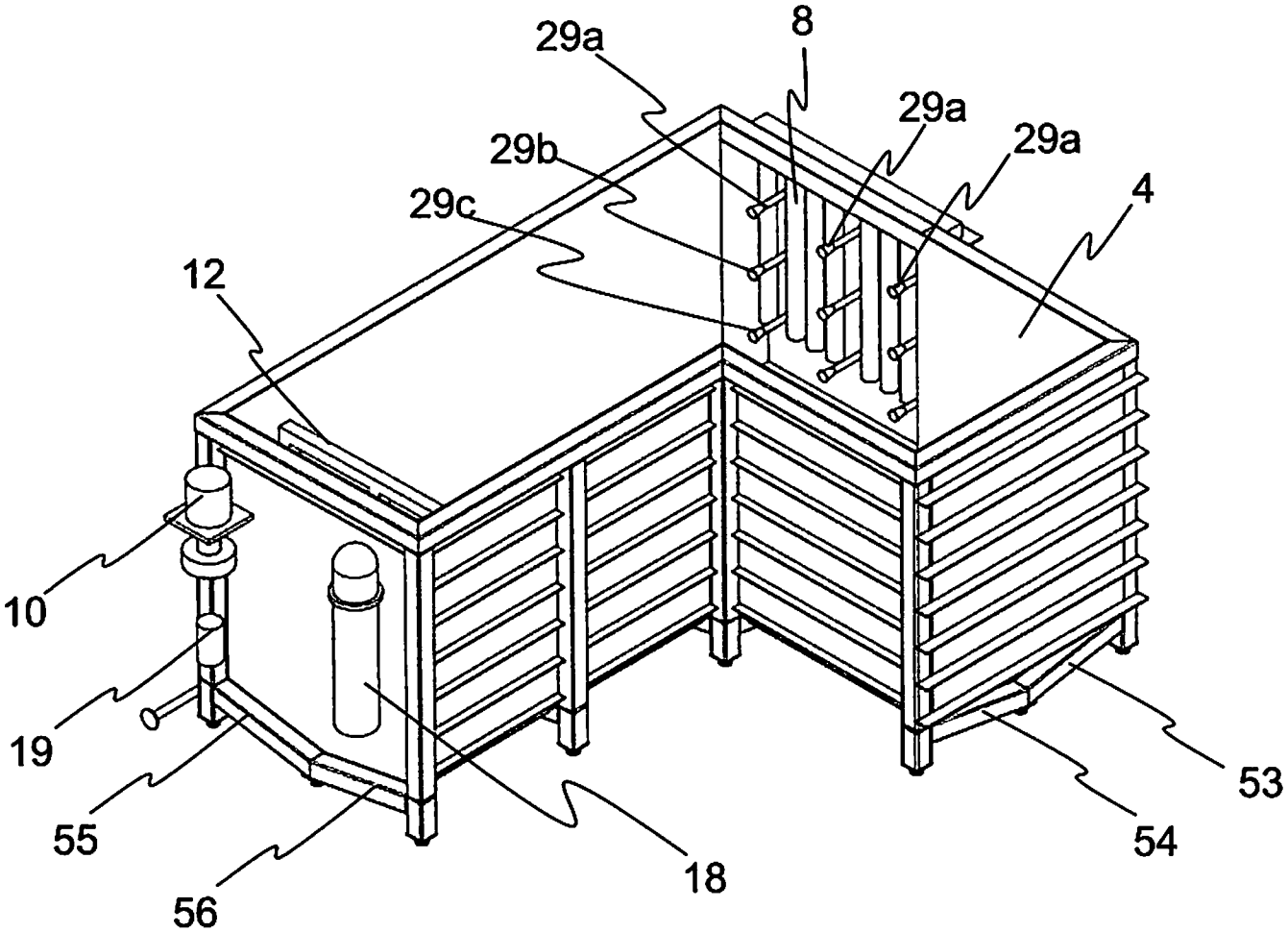
FIG. 5 is another perspective view of the treatment device according to the invention shown on FIG. 4.

FIG. 5 shows another view of the aforementioned embodiment of the treatment device 1 according to the invention. As may be gleaned from this illustration, the nozzles 29*a*-29*c* or 3×3 nozzle array are accommodated in a pocket 61 in a wall of the treatment container 4, so as preferably not to disrupt or adversely impact the effective area. The nozzles 28*a*-28*b* are preferably likewise accommodated in a pocket in another wall of the treatment container 4, so as preferably not to disrupt or adversely impact the effective area. The pockets 61 are preferably provided with ram protection, so as to prevent damage to the built-in components.

Further depicted is an additional filter device 19, wherein the additional filter device 19 is preferably designed as a coarse filter. The treatment substance to be prepared is especially preferably first siphoned out of the treatment container, then fed to the additional filter device 19, then guided through the pump 10, then guided through the filter device 18, which can preferably be designed as a bag filter, and then conveyed back into the treatment container via the nozzles 28, 29.

The illustration further shows that the floor of the treatment container 4 exhibits surface portions 53, 54, 55, that are inclined relative to the horizontal. The surface portions 53-54 and 55-56 are each preferably arranged in such a way as to yield a linear contact area with each other in the region of a low point as viewed in a vertical direction. The contact area here preferably lies at a level below a contact area between the outer wall of the container extending in a vertical direction and the respective surface portion or floor portion 53, 54. As a consequence, the surface portions or floor portions 53, 54 and 55, 56 preferably form grooves, which guide the treatment substance and dirt particles to one or more outlets in a targeted manner. The surface portions 53-56 are preferably aligned relative to the horizontal with an inclination of 2° to 25°, and especially preferably with an inclination of 6° to 15°, and most preferably with an inclination of essentially or precisely 10°.

Reference number 8 denotes a preferably provided temperature control device. The temperature control device 8 preferably exhibits 8 electrical heating elements, in particular at 2 KW each. The heating elements are preferably likewise accommodated in the pocket 61 in the wall, so as not to disrupt or negatively impact the preferably required effective surface. The heating capacity configuration of the temperature control device can preferably be oriented toward a Wessling system (20 $m^3$=20 KW heating capacity).

Figure 6:
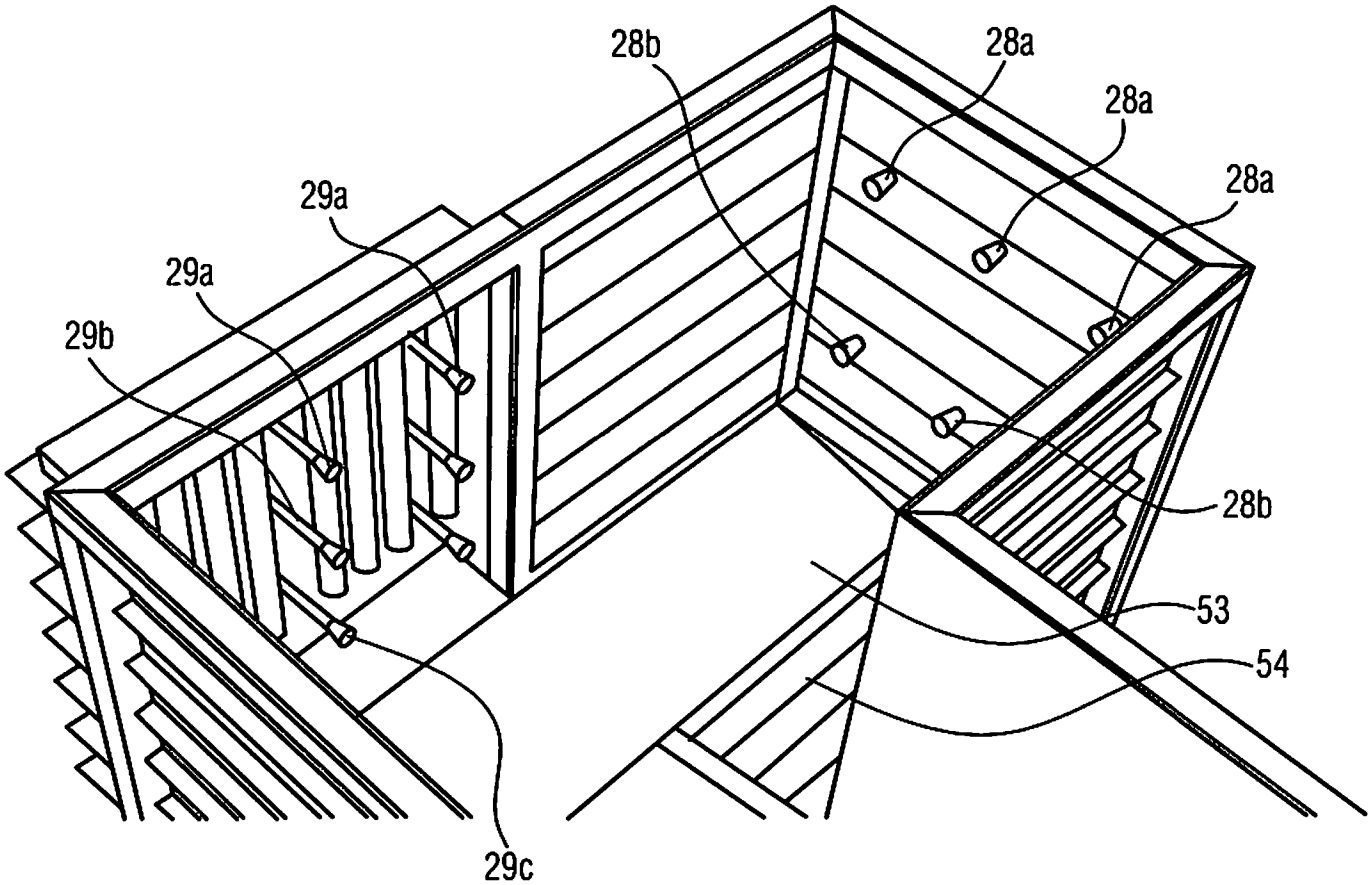
FIG. 6 is a perspective detailed view of part of the treatment device according to the invention shown on FIGS. 4 to 5.

In particular, FIG. 6 shows a detailed view of the pocket 61, in which the nozzles 29*a*-29*c* and temperature control device 8 are preferably situated.

FIG. 7 shows the first portion of a groove 62 produced by the floor portions 53, 54 and 55, 56 of the treatment container that are inclined relative to each other, and the resultant second portion 63 of the groove. The groove preferably also extends into the collecting chamber 14. Outlets 57*a*-57*f*, in particular several outlets, are especially provided in the groove or in the area of the groove for discharging or siphoning the treatment substance out of the treatment chamber. Further preferably provided in the collecting chamber 14 is at least one outlet 57*g* for discharging or siphoning the treatment substance out of the collecting chamber 14. The outlets 57*a*-57*g* are preferably fluidly joined with the primary suction line 61 via connecting lines.

Not shown is a grate, which is preferably horizontally aligned or aligned at a right angle to the lateral walls of the treatment container 4, and overlays the floor 53, 54, 55, 56 of the treatment chamber, wherein the grate is spaced apart from the floor, in particular by more than 20 mm, and preferably by more than 50 mm, and especially preferably by more than 100 mm, wherein the grate especially preferably is spaced apart from the floor of the treatment container by at most 500 mm. The grate preferably takes on the function of spacing an object to be treated that has been introduced into the treatment chamber apart from the floor of the treatment chamber, as a result of which particles that detached from the treated objects to be treated can accumulate under the object to be treated, so that these particles can always be siphoned out.

Figure 8:
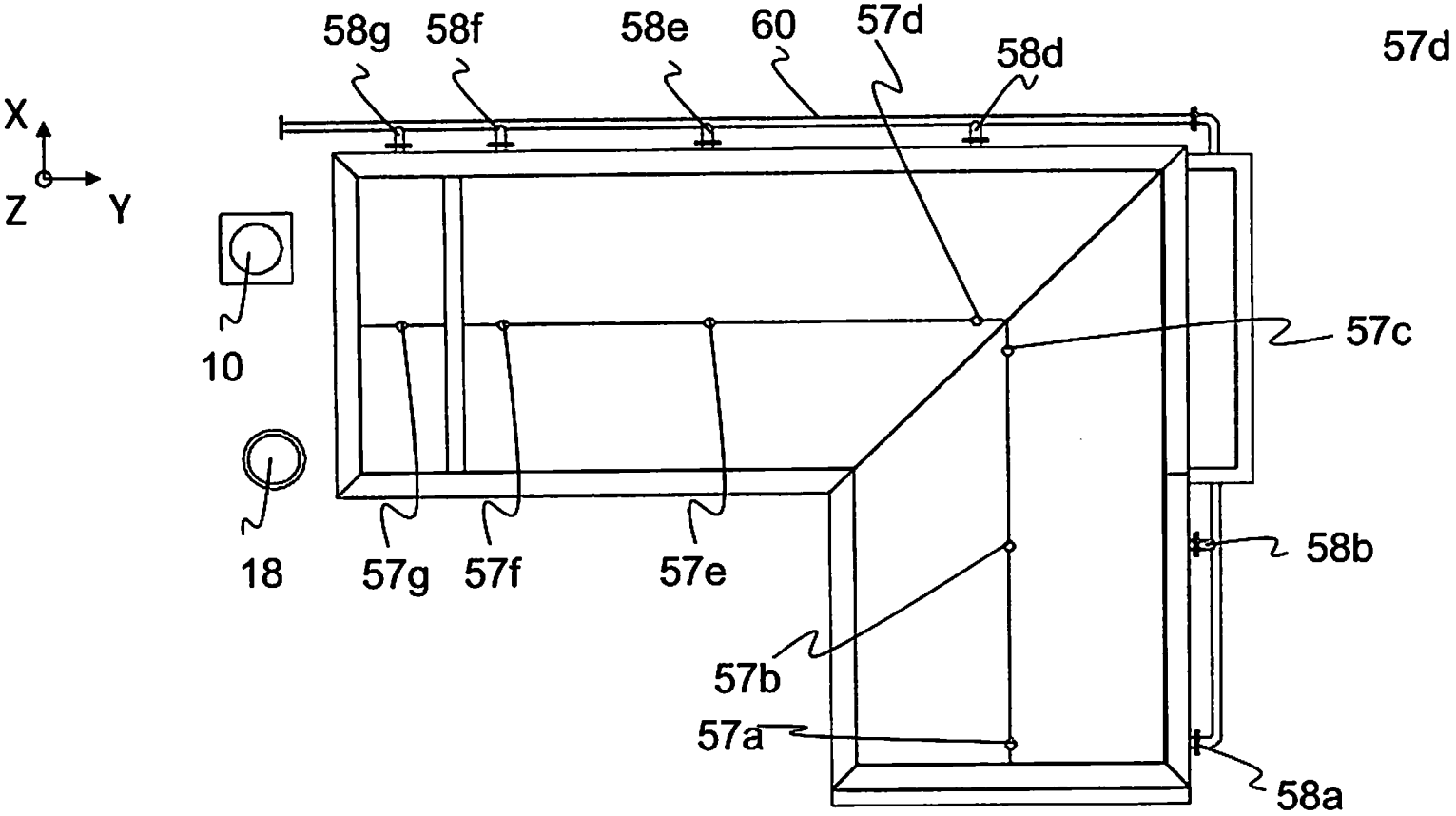
FIG. 8 is a second top view of the treatment device according to the invention shown on FIGS. 4 to 6.

FIG. 8 shows the primary suction line 60 and a portion of the connecting pipes 58*a*-58*g*, which join the outlets 57*a*-57*g* with the primary suction line 60. The overall suction line preferably comprised of at least the connecting pipes 58*a*-58*g* and the primary line 60 is preferably designed so that it can be dismantled. This is advantageous in particular for cleaning the individual parts of the overall suction line.

Figure 9:
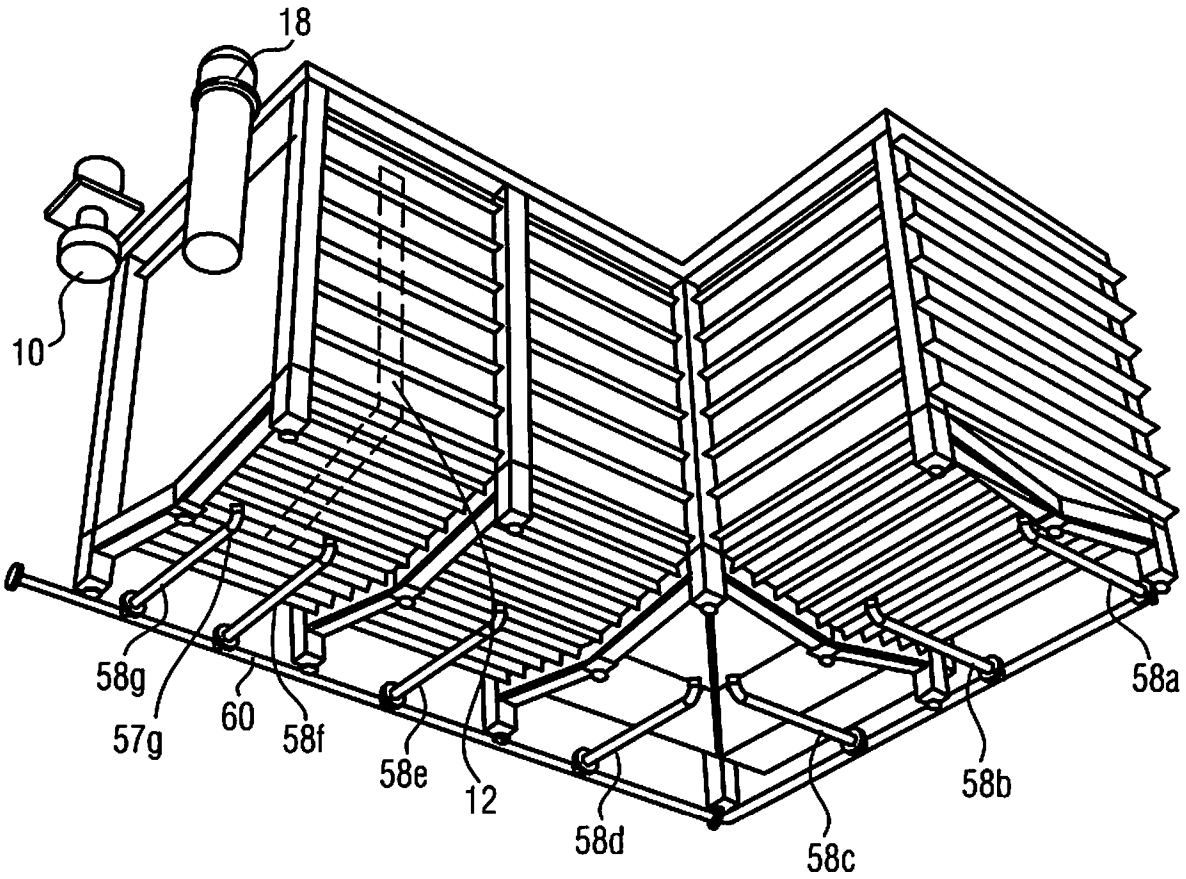
FIG. 9 is a perspective view of essentially the underside of the treatment device according to the invention shown on FIGS. 4 to 8.

FIG. 9 shows a perspective view of the underside of the treatment device 1 according to the invention. In particular the connecting pipes 58*a*-58*g* joined with the outlets and primary suction line can be derived from this illustration.

Figure 10A:
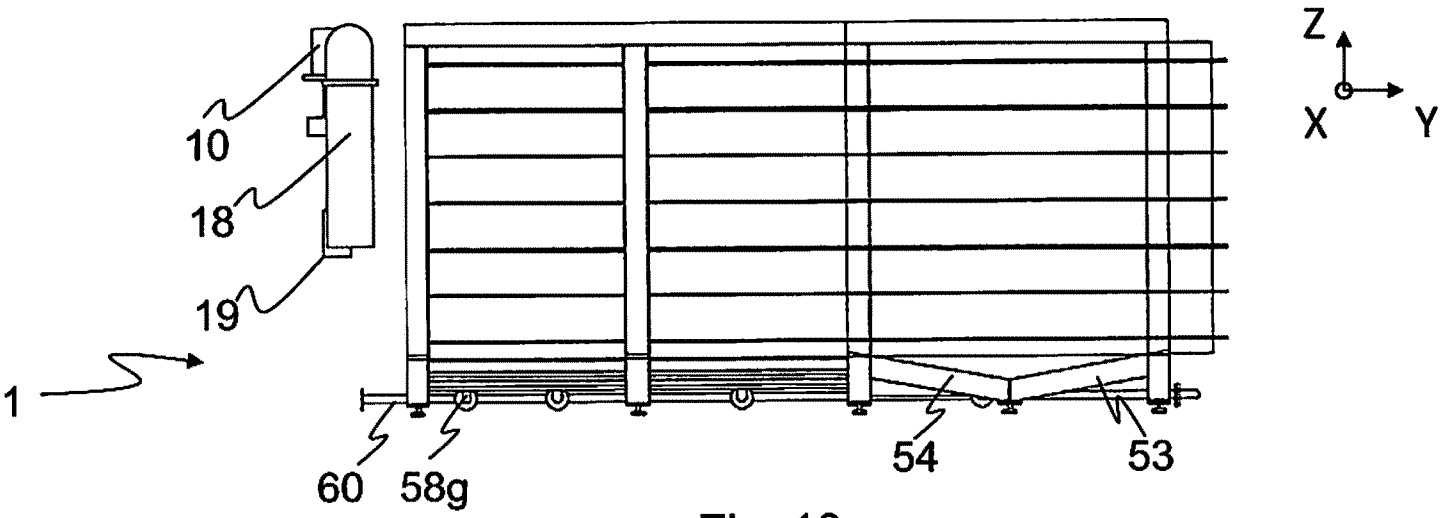
FIG. 10*a* is a first schematic side view of the treatment device according to the invention shown on FIGS. 4 to 9.
Figure 10B:
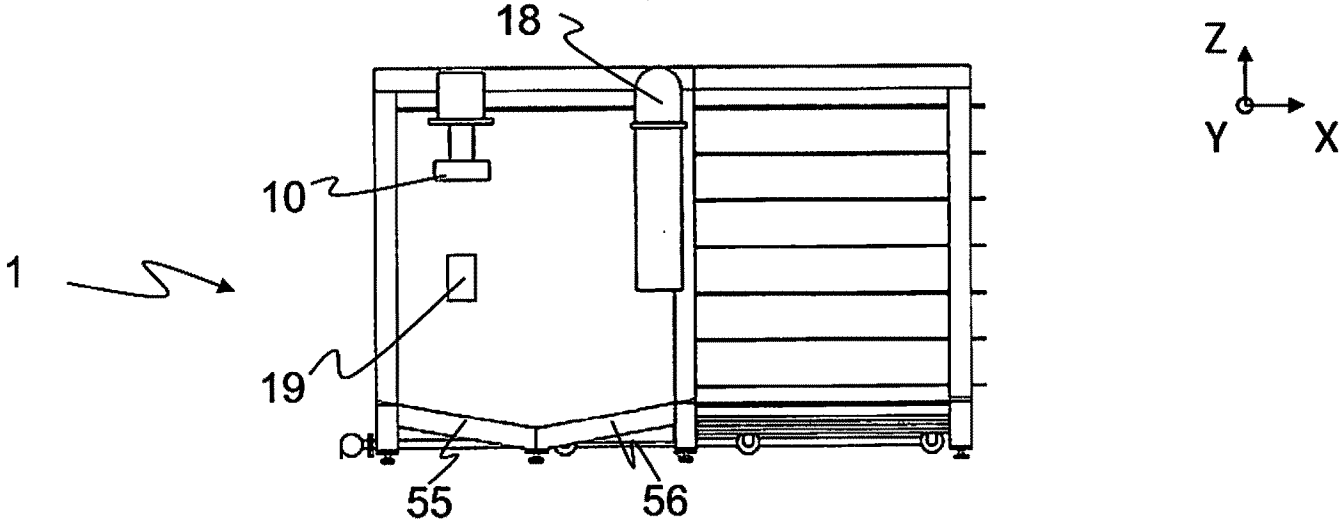
FIG. 10*b* is a second schematic side view of the treatment device according to the invention shown on FIGS. 4 to 9.

FIGS. 10*a* and 10*b* show various side views of the treatment device 1 according to the invention depicted on FIGS. 4 to 9.

The present invention relates to a treatment device 1 for the single-stage treatment of a metal object 2 to be treated, wherein the treatment encompasses at least the pickling and phosphating of the object 2 to be treated, wherein the treatment device 1 encompasses at least the devices mentioned below: a treatment container 4 for receiving the object 2 to be treated and for receiving a flowable treatment substance 6, and a pump device 10 for exchanging at least a fraction of the treatment substance 6, wherein the treatment substance 6 flows around at least one part of the object 2 to be treated, in particular the entire object 2 to be treated, wherein the treatment substance 6 is a phosphor or phosphate-containing solution, in particular phosphoric acid, wherein the phosphor or phosphate-containing solution consists partly of water and partly of a reaction substance, wherein the reaction substance consists of phosphor or a phosphate and an additional treatment effect-improving substance, wherein the proportion of the phosphor or phosphate in the reaction substance measures at least 95%, wherein the reaction substance in particular does not have a salt acid or sulfuric acid content.

REFERENCE LIST

1 Treatment device
2 Object to be treated
4 Treatment container
6 Treatment substance
8 Temperature control device
10 Pump device
12 Wall
14 Collecting chamber
16 Conveying line
18 Filter device
19 Additional filter device
20 Dam flow
22 Primary collecting chamber
24 First ancillary collecting chamber
26 Second ancillary collecting chamber
27 Grid
28 Nozzle
39 Wire coil
40 Treatment device for treating wire
41 Delivery point
42 Treatment bath
43 Fixation bath
44 Removal point
45 Transport device
46 Pressure belt filter device
47 Metering device
48 Fully decalcified water preparation device
49 Control device
50 Additional pressure belt filter device
51 Storage tank
52 Side channel compressor
53 First inclined floor portion
45 Second inclined floor portion
55 Third inclined floor portion
56 Fourth inclined floor portion
57 Outlet
58 Connecting pipe
60 Primary suction line
61 Pocket with nozzles
62 First portion of the groove
63 Second portion of the groove

The invention claimed is:

1. A treatment device for the single-stage treatment of a metal object to be treated, wherein the treatment encompasses at least pickling and phosphating of the object to be treated, wherein the treatment device comprises:

a treatment container for receiving the object to be treated and for receiving a flowable treatment substance; and a pump device for circulating at least a fraction of the treatment substance;

wherein the treatment substance is flowable around at least one part of the object to be treated, wherein the treatment substance is a phosphor or phosphate-containing solution, wherein the phosphor or phosphate-containing solution comprises water and a reaction substance, wherein the reaction substance comprises phosphor or a phosphate and at least one additional treatment effect-improving substance, wherein the proportion of the phosphor or phosphate in the reaction substance measures at least 95%, wherein the reaction substance does not have a salt acid or sulfuric acid content, wherein the treatment container is separated by a wall from a collecting chamber for collecting treatment substance flowing over the wall, wherein the treatment substance collected in the collecting chamber can be conveyed back into the treatment container via a conveying line, wherein a filter device is provided for filtering the treatment substance to remove contaminants from the treatment substance that have accumulated in the treatment substance, wherein the pump device and filter device make up part of the conveying line, and the pump device is operable to convey the treatment substance through the filter device, wherein the conveying line is configured in such a way that the treatment substance conveyed back into the treatment container can generate a dam flow for discharging a portion of the treatment substance from the treatment container and into the collecting chamber.

2. The treatment device according to claim 1 further comprising a temperature control device for controlling temperature of the treatment substance that can be held in the treatment container, wherein the temperature control device can be used to definably set the temperature of the treatment substance.

3. The treatment device according to claim 1 wherein the water of the phosphor or phosphate-containing solution comprises fully decalcified water, the fully decalcified water comprises VE water, and the fraction of reaction substance relative to the fraction of fully decalcified water lies between 1:4 and 1:7.

4. The treatment device according to claim 3 wherein the fraction of reaction substance relative to the fraction of fully decalcified water measures 1:6 if the reaction substance is present in a solid state before mixed with the fully decalcified water or wherein the fraction of reaction substance relative to the fraction of fully decalcified water measures 1:5 if the reaction substance is present in a liquid state before mixed with the fully decalcified water.

5. The treatment device according to claim 1 wherein the reaction substance further exhibits no fractions of fluorine, chlorine, bromine, iodine, lead, mercury and selenium.

6. The treatment device according to claim 1 wherein the fraction of phosphor or phosphate in the reaction substance measures at least 97%.

7. The treatment device according to claim 1 wherein a pore-free protective layer that prevents hydrogen embrittlement while drying the treatment substance is generatable on the surface of the object to be treated by means of the treatment substance, wherein the protective layer exhibits a thickness of 2 μm to 10 μm.

8. The treatment device according to claim 1 wherein an additional substance for pickling and degreasing is added to the treatment substance, wherein the pickling and degreasing additive comprises an aqueous solution of non-ionogenic, biodegradable surfactants and inhibitors, and wherein the pickling and degreasing additive is added with a volume of 0.5% to 7% of the volume of the phosphor or phosphate-containing solution.

9. The treatment device according to claim 1 wherein an additional substance for defoaming is added to the treatment substance, wherein the defoaming additive preferably exhibits triisobutyl phosphate, and wherein the defoaming additive is added to the treatment substance with a volume of 0.01% to 5%, in particular with 0.2%, of the volume of the phosphor or phosphate-containing solution, or with a volume of 0.01% to 5%, in particular with 0.2%, of the volume of the phosphor or phosphate-containing solution reacted with the pickling and degreasing additive.

10. The treatment device according to claim 2 wherein the treatment container comprises a primary receiving chamber, into which the object to be treated can be introduced, and at least one first ancillary receiving chamber, wherein the primary receiving chamber and first ancillary receiving chamber are joined together in such a way that the treatment substance can flow out of the primary receiving chamber and into the first ancillary receiving chamber on the one hand, and can flow out of the first ancillary receiving chamber and into the primary receiving chamber on the other, wherein the primary receiving chamber and the first ancillary receiving chamber are separated from each other in such a way as to at least partially prevent the object to be treated from penetrating into the first ancillary receiving chamber, and wherein the primary receiving chamber is also coupled with a second ancillary receiving chamber, wherein the first ancillary receiving chamber is a buffer receiving chamber for receiving a specific quantity of the treatment substance, and wherein the second ancillary receiving chamber is a temperature control chamber, wherein the temperature control device is at least partially situated in the second ancillary receiving chamber.

11. The treatment device according to claim 2 further comprising a control device, wherein the control device is configured to control the temperature control device in such a way that the treatment substance is brought to a target temperature or target temperature progression and/or the control device is configured to control the pump device in such a way that the treatment substance is conveyed at a target flow rate or target flow characteristic, and/or the control device is configured to control the filter device in such a way that a filtered fraction of treatment substance exhibits a target purity, and/or the control device is configured to control a metering device in such a way that a target composition of the treatment substance can be set.

12. The treatment device according to claim 1 wherein the conveying line has an outlet opening located at an upper end of the treatment container.

13. A treatment method for at least pickling and phosphating a metal object to be treated, the method comprising:

providing a treatment container for receiving at least one object to be treated and for receiving a flowable treatment substance;

introducing the treatment substance into the treatment container, wherein no additional treatment container is used for pickling and phosphating; and introducing the object to be treated into the treatment container at least partially filled with the treatment substance to bring the object to be treated into contact with the treatment substance;

wherein the contact between the treatment substance and object to be treated triggers at least a cleaning of the object to be treated, wherein the treatment substance is a phosphor or phosphate-containing solution, wherein the phosphor or phosphate-containing solution comprises water and a reaction substance, wherein the reaction substance comprises phosphor or a phosphate and an additional treatment effect-improving substance, wherein the fraction of phosphor or phosphate in the reaction substance measures at least 95%, wherein the reaction substance exhibits no fractions of salt acid and sulfuric acid, wherein the treatment container is separated by a wall from a collecting chamber for collecting treatment substance flowing over the wall, wherein the treatment substance collected in the collecting chamber can be conveyed back into the treatment container via a conveying line, wherein a filter device for filtering the treatment substance is provided, wherein filtration removes contaminants from the treatment substance that have accumulated in the treatment sub stance, wherein the pump device and filter device make up part of the conveying line, and the conveyed treatment substance is conveyed by the pump device through the filter device, wherein the conveying line is configured in such a way that the treatment substance conveyed back into the treatment container can generate a dam flow for discharging a portion of the treatment substance from the treatment container and into the collecting chamber.

14. The method according to claim 13 further comprising:

adding an additional substance for pickling and degreasing to the treatment sub stance, wherein the pickling and degreasing additive comprises an aqueous solution of non-ionogenic, biodegradable surfactants and inhibitors, and wherein the pickling and degreasing additive is added with a volume of 0.5% to 7% of the volume of the phosphor or phosphate-containing solution.

15. The method according to claim 13 wherein an additional substance for defoaming is added to the treatment substance, wherein the defoaming additive comprises triisobutyl phosphate, and wherein the defoaming additive is added to the treatment substance with a volume of 0.01% to 5% of the volume of the treatment substance, or with a volume of 0.01% to 5% of the volume of the treatment substance reacted with the pickling and degreasing additive.

16. The method according to claim 13 wherein a pore-free protective layer that prevents hydrogen embrittlement after drying the treatment substance is generated on the surface of the object to be treated by means of the treatment substance, wherein the protective layer exhibits a thickness of 2 μm to 10 μm.

17. The method according to claim 13 wherein the phosphor or phosphate-containing solution comprises fully decalcified water and the reaction substance, wherein the fully decalcified water comprises VE water, and the fraction of reaction substance relative to the fraction of fully decalcified water lies between 1:4 and 1:7.

18. The method according to claim 13 wherein the fraction of phosphor or phosphate in the reaction substance measures at least 99%.

19. The method according to claim 13 wherein the treatment substance is brought to a definably set temperature by means of a temperature control device, and made to react with the object to be treated in the treatment container.

20. The method according to claim 13 wherein the reaction substance exhibits no fluorine, chlorine, bromine, iodine, lead, selenium and mercury.

* * * * *